US008005250B2

(12) United States Patent
Josephson et al.

(10) Patent No.: US 8,005,250 B2
(45) Date of Patent: Aug. 23, 2011

(54) MICROPHONE HOUSING

(75) Inventors: David Lane Josephson, Santa Cruz, CA (US); David M. Gordon, Soquel, CA (US); Kelly Q. Kay, Santa Cruz, CA (US)

(73) Assignee: Josephson Engineering, Inc., Santa Cruz, CA (US)

( * ) Notice: Subject to any disclaimer, the term of this patent is extended or adjusted under 35 U.S.C. 154(b) by 501 days.

(21) Appl. No.: 12/340,711

(22) Filed: Dec. 20, 2008

(65) Prior Publication Data

US 2009/0169043 A1 Jul. 2, 2009

Related U.S. Application Data

(60) Provisional application No. 61/016,108, filed on Dec. 21, 2007.

(51) Int. Cl.
*H04R 9/08* (2006.01)

(52) U.S. Cl. ..... 381/355; 381/347; 381/359

(58) Field of Classification Search ..... 381/347, 381/355, 359
See application file for complete search history.

(56) References Cited

U.S. PATENT DOCUMENTS

| | | | | |
|---|---|---|---|---|
| 2,680,787 | A * | 6/1954 | Olson et al. | 381/176 |
| 5,781,643 | A * | 7/1998 | Anderson | 381/355 |
| 6,554,097 | B2 * | 4/2003 | Konig | 181/129 |

* cited by examiner

*Primary Examiner* — Long Tran

(57) ABSTRACT

One embodiment of a microphone housing having at its base a cylindrical solid section (4) containing circuit boards (3) and on which is mounted transducer (2) and acoustically permeable basket (1). The basket is made of rigid, conductive foam providing electrical shielding, mechanical protection and wind and pop screening, without appreciably altering the acoustical characteristics of the transducer. Another embodiment is also described and shown.

2 Claims, 1 Drawing Sheet

MICROPHONE HOUSING

CROSS-REFERENCE TO RELATED APPLICATIONS

This application claims the benefit of provisional patent application Ser. No. 61/016,108 dated Dec. 21, 2007 by the present inventors.

FEDERALLY SPONSORED RESEARCH

Not Applicable

SEQUENCE LISTING

Not Applicable

BACKGROUND OF THE INVENTION

This invention relates to a conductive, acoustically permeable housing, which provides electrical shielding and mechanical protection of a microphone transducer.

Microphones often utilize transducers which operate at very high impedance and low signal amplitude, requiring shielding to prevent external electric fields from being coupled into the microphone circuit. The transducers are often physically fragile, because high compliance in the moving structure is required to produce good performance. These two factors together require a robust housing to enclose the transducer. Such a housing, when it is robust enough to provide the needed protection, often has undesirable acoustical influence on the performance the transducer due to reflections from solid surfaces that make up the housing.

It is well known to enclose a microphone transducer in a basket or grille of one or more layers of perforated metal or wire cloth. Because of the flexible nature of this material, it is often attached to a support structure of solid material. Sound arriving at the microphone may pass through the open grille or may strike and be scattered by its support structure. Once sound is inside the housing, it may be reflected multiple times between parallel or coaxial surfaces. This scattering and reflection may result in anomalies in frequency and phase response of the microphone due to interference between the original sound waves and the scattered or reflected waves.

Previous attempts to resolve this problem have concentrated on reducing the use of parallel or coaxial surfaces that might give rise to internal reflections within the housing. Common shapes have included slanted, tapered and irregularly shaped surfaces. Additional structure, which creates its own reflections, is needed to support the housing, since most of the acoustically permeable grille or basket is of flexible mesh or woven material.

It is also known, for example in the AKG D-202 microphone made in the 1960s, and as described recently in US Patent Application 2007/0003095 to employ sintered plastic or metal to provide mechanical protection and wind screening, but such sintered material, being made of substantially spherical grains bonded together, typically has an open area of less than 50% and as such produces significant alteration in the sound due to its flow resistance.

An additional problem is that microphones are sensitive to wind and breath noises, which cause undesirable degradation in the sound pickup. It is also known to provide wind and pop shielding for microphone transducers by enclosing them within a body of reticulated, open cell plastic foam, as taught in U.S. Pat. No. 3,236,328 to Lou Burroughs. Such wind and pop screening material provides no electrical shielding, and is subject to degradation as the plastic ages.

BRIEF SUMMARY OF THE INVENTION

In accordance with one embodiment a microphone housing comprises a hollow cylindrical basket, closed on one end and made of rigid metal foam.

DRAWINGS

Reference Numerals

FIG. 1

1—microphone housing, acoustically permeable section
2—microphone transducer
3—electronics boards
4—microphone housing, solid section

FIG. 2

1—microphone housing, acoustically permeable section
2—microphone transducer
3—electronics board
4—microphone housing, solid section

DETAILED DESCRIPTION

Figure 1:
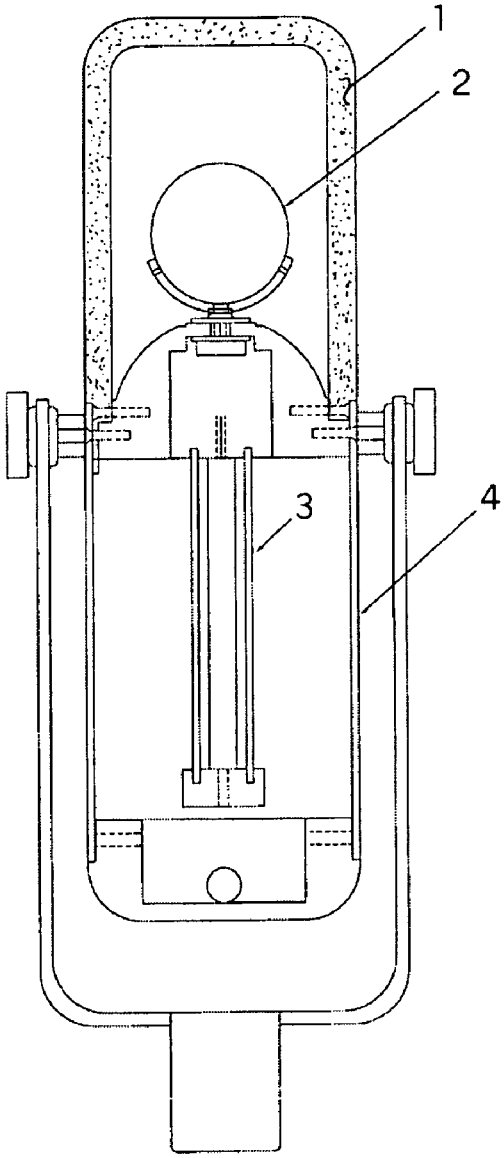
FIG. 1 shows a cross-section view of a microphone housing in accordance with one embodiment.

FIG. 1—First Embodiment

One embodiment of this housing is illustrated in FIG. 1. The housing has a hollow metal cylindrical section 4 enclosing circuit boards 3 and at one end of which is mounted transducer 2, as known in prior art. An acoustically permeable basket-shaped section made of conductive foam 1 is attached to the solid section, forming a complete enclosure around the transducer of substantially uniform wall thickness. In this embodiment, the solid section is made of aluminum alloy and the foam basket is made of reticulated, open cell, solid ligament aluminum foam, available from ERG Aerospace of Oakland, Calif. under the trade name Duocel. However, the housing may consist of any other substantially conductive material that provides the necessary shape, open area and physical strength such as electroformed metal, conductive plastic or metallized ceramic foam.

In this embodiment, the housing is about 60 mm in outer diameter and 220 mm long. The conductive foam basket section is made of 6061 aluminum alloy, 8 mm thick overall, with 10 to 20 pores per inch and an open area of 80 to 90 percent. During manufacture it is tempered for working and finally heat-treated to approximately T6 condition to provide the requisite mechanical strength. The conductive foam basket 1 is manufactured to a uniform density and machined to a suitable thickness so that the acoustical resistance of the material is substantially uniform for sound arriving from any direction. Said basket is bonded to the lower housing 4 using brazing or conductive epoxy, so that the shielding characteristic is retained.

One is concerned with internal reflections within the microphone basket. A reflection or scattering occurs when the sound wave traveling in air reaches a material of different density. Due to the random nature of bubbles in the foam which ultimately define the open cell ligaments, the locations of the walls of a basket made of foam are distributed over its entire thickness, rather than being at the closest surface as in the case of perforated metal or wire mesh. Also, the acoustic impedance of the open-cell material is close to that of air, so that very little of the sound is scattered back to the transducer. Due to the strength of the foam material, no additional support structure is needed to present additional scattering surfaces. The result is significantly weaker reflections from the basket, compared with a structure offering similar protection, constructed from perforated metal or wire mesh.

Because the foam ligaments are oriented randomly, open cell foam material has nearly uniform modulus and crush strength in all directions. A basket of similar open area made of wire mesh or perforated sheet must be supported with external structure if the resultant housing is to be robust, whereas the foam material is self-supporting.

The metal foam basket also provides a similar degree of wind and pop noise reduction as would a plastic foam windscreen of similar dimensions, due to the diffusion of airflow in turbulence as the air is required to change direction around the ligaments of the foam.

Figure 2:
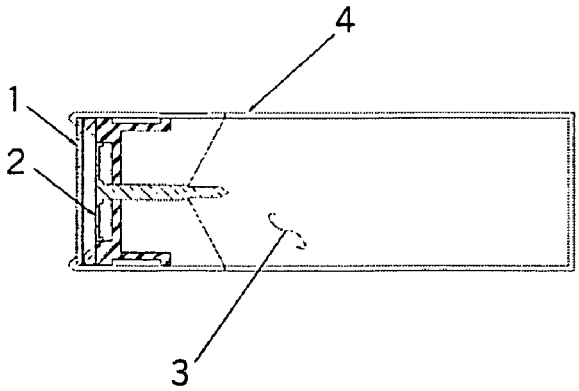
FIG. 2 shows a cross-section view of another microphone housing in accordance with an alternate embodiment.

FIG. 2—Additional Embodiment

Some microphones use a transducer with front and back sides, both of which are open to the air, as shown in FIG. 1. Such microphones are intended to have their primary sound entry radial to the long axis of the microphone. Others, as shown in FIG. 2, incorporate the microphone transducer and its protective element as one end of a cylindrical housing and are axially addressed. The additional embodiment of this invention shown in FIG. 2 uses the same type of conductive foam material 1 to provide electrical and mechanical protection for transducer 2 and to close one end of a cylindrical microphone body 4 which encloses circuit board 3.

CONCLUSIONS, RAMIFICATIONS AND SCOPE

The reader will see that the conductive foam element in these embodiments can be used to provide a housing for a microphone transducer allowing it to be used with maximum protection and minimum acoustical compromise, or it can provide a window in a solid housing for sound to enter. It provides a housing or sound entry port that has substantially uniform acoustic resistance in all directions without interruption from support structure, and which is uniformly strong.

Although the description above contains many specificities, these should not be construed as limiting the scope of the embodiments, but as merely providing illustrations of some of the present embodiments. For example, the housing can be of any solid shape, such as prismatic, ovoid or spherical; the conductive foam material may be of other materials than aluminum, such as electroformed, plated or vacuum-deposited metal on various substrates or conductive plastic; the housing may include a solid section as shown or may consist entirely of foam. In the embodiments herein, the conductive foam element has negligible acoustic influence on the sound reaching the transducer, however in alternate embodiments the foam characteristics could be altered to achieve desired acoustical properties in addition to providing electrical and mechanical protection.

Thus the scope of the embodiments should be determined by the appended claims and their legal equivalents, rather than by the examples given.

The invention claimed is:

1. A microphone comprising a transducer element at least partially enclosed by an acoustically permeable housing, wherein only a portion of said housing consists of metallic, electrically conductive open cell reticulated foam; thereby providing electrical shielding without altering acoustical characteristics of the transducer; and wherein said metallic, electrically conductive open cell reticulated foam comprises one end of otherwise solid housing.

2. The microphone of claim 1, wherein said housing is comprised of solid ligament metal foam.

* * * * *